US007277552B2

(12) United States Patent
Graber

(10) Patent No.: US 7,277,552 B2
(45) Date of Patent: Oct. 2, 2007

(54) INCREASED LF SPECTRUM POWER DENSITY LOUDSPEAKER SYSTEM

(76) Inventor: Curtis E. Graber, 9301 Roberts Rd., Woodburn, IN (US) 46797

( * ) Notice: Subject to any disclaimer, the term of this patent is extended or adjusted under 35 U.S.C. 154(b) by 660 days.

(21) Appl. No.: 10/914,653

(22) Filed: Aug. 9, 2004

(65) Prior Publication Data

US 2006/0029241 A1 Feb. 9, 2006

(51) Int. Cl.
*H04R 1/28* (2006.01)

(52) U.S. Cl. ..... 381/182; 381/351; 181/199

(58) Field of Classification Search ..... 381/89, 381/182, 335, 345, 349–351; 181/199
See application file for complete search history.

(56) References Cited

U.S. PATENT DOCUMENTS

| | | | | |
|---|---|---|---|---|
| 4,016,953 A | | 4/1977 | Butler | |
| 4,466,505 A | | 8/1984 | Ritter | |
| 5,258,584 A | | 11/1993 | Hubbard | |
| 5,590,208 A | * | 12/1996 | Koyano et al. | 381/345 |
| 5,590,214 A | | 12/1996 | Nakamura | |
| 5,594,804 A | | 1/1997 | Kim | |
| 5,621,804 A | * | 4/1997 | Beppu | 381/345 |
| 5,815,589 A | | 9/1998 | Wainwright et al. | |
| 6,118,883 A | | 9/2000 | Rocha | |
| 6,363,157 B1 | | 3/2002 | Chick | |
| 6,411,718 B1 | | 6/2002 | Danley et al. | |
| 6,621,909 B1 | | 9/2003 | Webb et al. | |
| 6,985,593 B2 | * | 1/2006 | Nichols et al. | 381/182 |

FOREIGN PATENT DOCUMENTS

| | | |
|---|---|---|
| FR | 2405608 | 5/1979 |
| GB | 830020 | 3/1960 |
| GB | 2256344 | 12/1992 |
| NL | 9200135 | 8/1993 |

OTHER PUBLICATIONS

Charles D. Segelbaum, Feb. 28, 2006 Private Correspondence and Attachments.

* cited by examiner

*Primary Examiner*—Daniel Swerdlow
(74) *Attorney, Agent, or Firm*—Paul W. O'Malley; Susan L. Firestone

(57) ABSTRACT

The power density of a bass-reflex enclosure is improved by providing transducers in pairs, with the members of each pair being oriented front to back with respect to one another. The transducers are mounted on the enclosure with at least one of the transducers being substantially perpendicular to a front face of the enclosure and having its backside partially rested in the second transducer of the pair. The gap between the transducers is wider on the side open to the surrounding environment through the front face. Directivity may be provided by incorporating a second pair of transducers.

18 Claims, 6 Drawing Sheets

INCREASED LF SPECTRUM POWER DENSITY LOUDSPEAKER SYSTEM

BACKGROUND OF THE INVENTION

1. Technical Field

The invention relates to loudspeaker systems, and more particularly is directed to loudspeaker system intended for high efficiency, bass system for either out of doors or large enclosed space applications.

2. Description of the Problem

A great part of the usefulness of a loudspeaker system depends upon the effectiveness of the enclosure in which the sound transducers are housed. Effectiveness as a term must be understood in a somewhat relative sense, since a sound system may be dedicated to a particular environment, or it be intended to be mobile, it may be intended to reproduce low frequency sound or high frequency sound, it may be intended for high fidelity reproduction of Baroque music or it may be intended for extremely high efficiency radiation of voice in a stadium setting where some distortion is tolerable as long as intelligibility is preserved. The system should also deliver or direct the sound reproduced to the intended audience.

Accordingly, efficiency, as the term is used herein, should be understood to comprehend increased sound energy density in watt-seconds per cubic meters at desired locations and at the desired frequencies without increases in electrical power input to the sound transducers in the loudspeaker system.

It is well known that sound energy density may be increased in particular areas by increasing the directivity of a loudspeaker system. This may involve confining the sound energy to a beam, potentially in both vertical and horizontal planes, and than controlling the width of the beam. Directivity is achieved in a number of ways including phase control over doublets of radiators, arrays of radiators, baffles, enclosures and horn loading, etc. Horns and bass reflex enclosures are particularly favored, with horns providing the higher efficiencies, typically at the cost of distortion of the sound. Of course both horns and enclosures come in a baffling variety of forms. The development of neither horns nor bass reflex enclosures is exhausted, particularly with respect to the positioning of multiple element transducers on the enclosure and use of electronics to control the relative phase in sound reproduction between the transducers.

SUMMARY OF THE INVENTION

According to the invention there is provided a bass-reflex enclosure promoting higher power density of low frequency sound energy radiated by transducers mounted on the enclosure. The transducers are arranged in pairs with at least one pair being provided. Each pair of transducers is arranged in a front to back relationship, spaced by no more than a quarter of a wavelength of the sound radiated by the transducers at an optimal design limit frequency. One face of each of the transducers is directed into the interior volume of the enclosure. The opposed faces are open to the environment through a gap in the front face of the enclosure. The spacing between the transducers is wider along the side closest to the gap. An audio driver provides for driving the transducers of a pair in phase with one another. The proximity and orientation of the loudspeakers voice coils provides improvement in acceleration from the voice coils. Directivity may be provided by incorporating a second pair of transducers constructed after the pattern of the first pair, but spaced from the first pair along the front face. Where two pairs of transducers are provided a delay line is incorporated for delaying the signal to one of the two pairs relative to the other. The units are intended for extremely high efficiency reproduction of bass sound at or below a design frequency.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
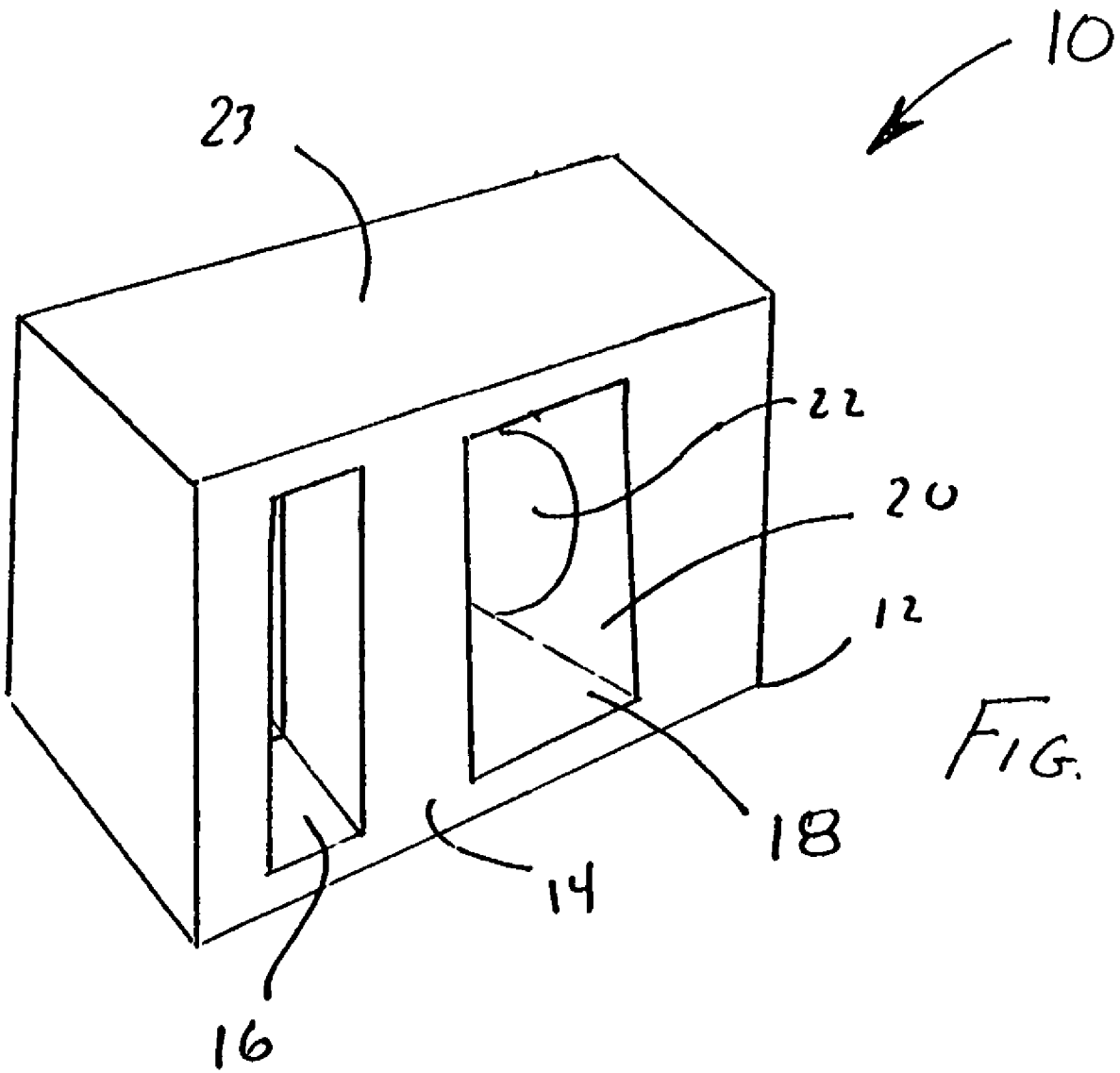
FIG. 1 is perspective view of a bass-reflex loudspeaker enclosure in accordance with a first embodiment of the invention.
Figure 2:
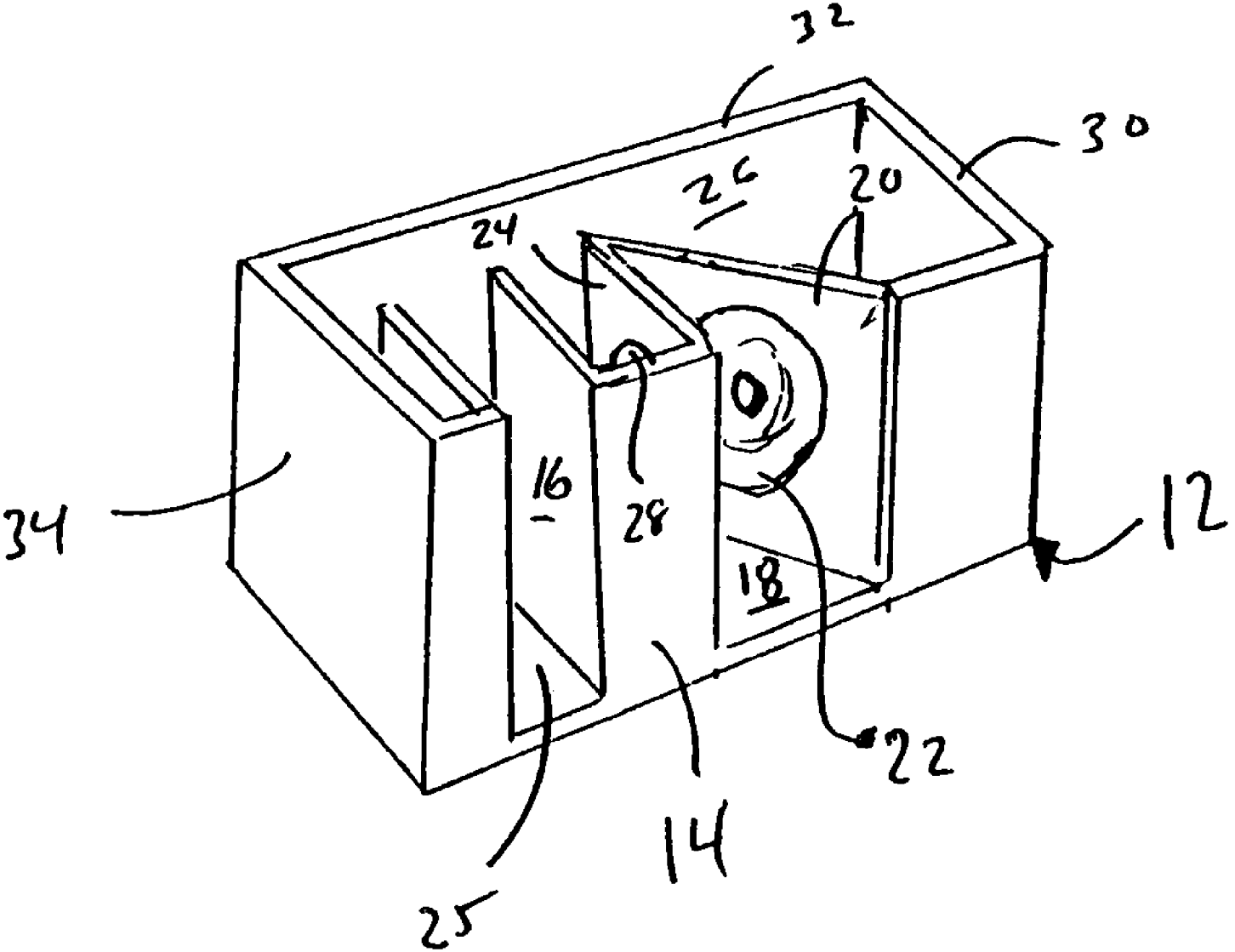
FIG. 2 is a partially cutaway perspective view of the bass-reflex enclosure of FIG. 1.
Figure 3:
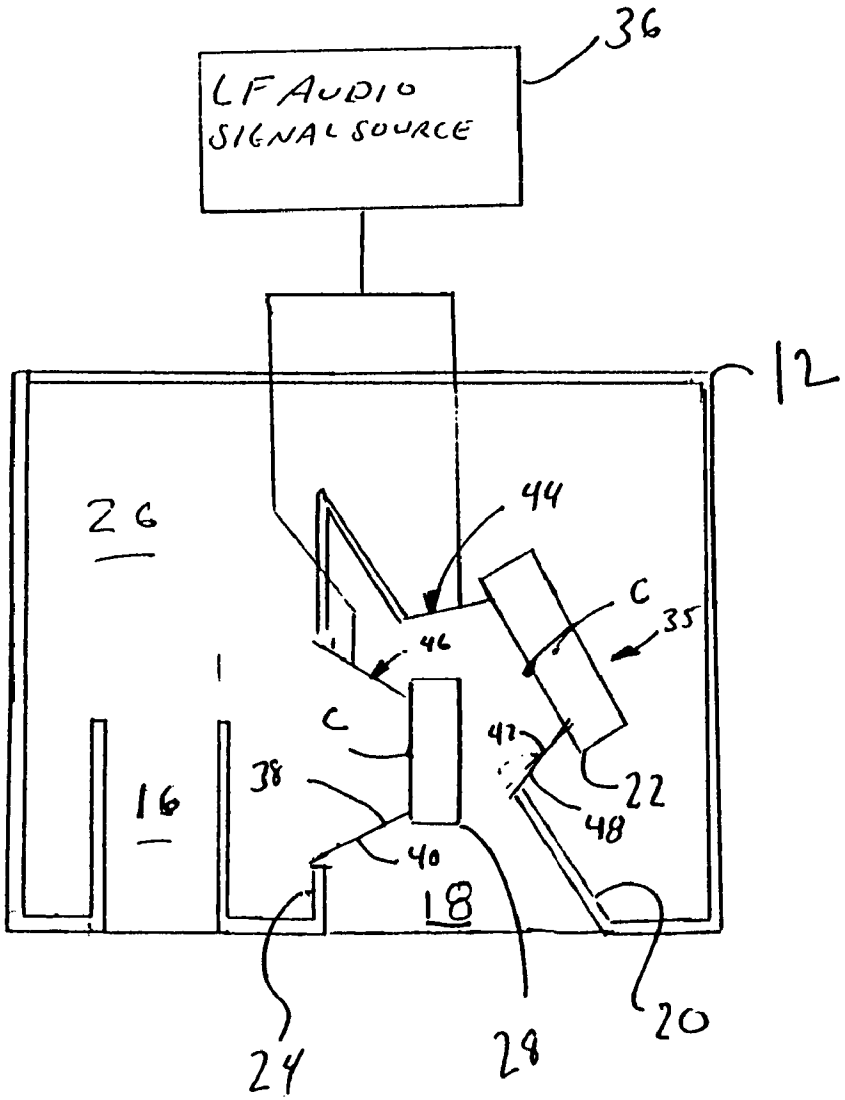
FIG. 3 is a schematic of the first embodiment of the invention.

Referring now to FIGS. 1-3 and in particular to FIG. 1, a loudspeaker system 10 in accordance with a first embodiment of the invention is constructed using a bass-reflex enclosure 12 promoting the radiation of low frequency sound energy at high power density levels. A pair of transducers, including cone loudspeaker 22, is mounted with respect to a forward face 14 of enclosure 12 in a baffle 20 behind mouth 18. A forward oriented port 16 is located through forward face 14 to one side of mouth 18. Port 16 is tuned and can be in series or cascaded.

Referring to FIGS. 1 and 2, details of the construction of bass-reflex enclosure 12 may be seen. Bass-reflex enclosure 12 conventionally defines an enclosed volume 26 within a rectangular box formed by front face 14, sides 30 and 34 and a back wall 32, as well as a cover 23 and a base 25. A conventional tuned port 16 allows sound energy to escape from enclosed volume 26 to the exterior environment through a tube having a cross sectional area which is less than the area of the diaphragms of the transducers (loudspeakers 22 and 28). Loudspeakers 22 and 28 are woofers of conventional type having diaphragms with front and back sides radiating sound energy, voice coils (not shown) and support webbing (not shown). Woofers of an identical type are paired, with one woofer each being mounted in one of substantially facing baffles 20 and 24. Baffle 24 is disposed at a right angle with respect to front face 14 and extends from the front face 14 back into the interior of bass-reflex enclosure 12. Baffle 20 extends from one edge along front face 14 into the interior of bass-reflex enclosure 12 forming an oblique angle with the front face inside of the bass-reflex enclosure and meeting baffle 24 along an opposite edge. The gap between the edges of baffles 20 and 24 on front face 14 forms a mouth 18. Enclosed volume 26 is tuned to a preferred resonant frequency. The volume formed between baffles 24 and 26 behind mouth 16 is also tuned.

Referring to FIG. 3, the relative position of cone loudspeakers 22 and 28 is illustrated. Loudspeakers 22 and 28 are arranged as a pair 35 behind mouth 18. Loudspeaker 28 is mounted on baffle 24, oriented to radiate sound from the front side 38 of diaphragm 46 into enclosed volume 26. Loudspeaker 22 is mounted in baffle 20 to radiate sound from the back side 48 of diaphragm 44 into enclosed volume 26. The front side 42 of loudspeaker 22 is directed into the back side 40 of loudspeaker 28. Put another way, loudspeaker 28 is partially nested in loudspeaker 22. The acoustic centers C of loudspeakers 22 and 28 are spaced by no more than a quarter of a wavelength of an design limit frequency. For a 200 Hz design limit the maximum desired gap would be a little over one and a quarter feet. The closer the transducers are brought raises the high end of the frequency to the which the system can operate. A low frequency (LF) audio signal source 36 provides an audio signal which is applied to the identical woofers synchronized in phase. Accordingly, back side 40 of loudspeaker 28 is excited 180 degrees out of phase with the front side 42 of loudspeaker 22. As a result the transducers, though arranged as a doublet, should function as a simple source. Air pressure changes within enclosed volume 26 should cancel. Loudspeaker 22 is canted with respect to loudspeaker 28 with the result that the gap between the loudspeakers is wider along the edge closer to mouth 18 and to the exterior operating environment. The volume of the indentation between baffles 62 and 64 is tuned and mouth 58 area is tuned for a resonant frequency.

Figure 4:
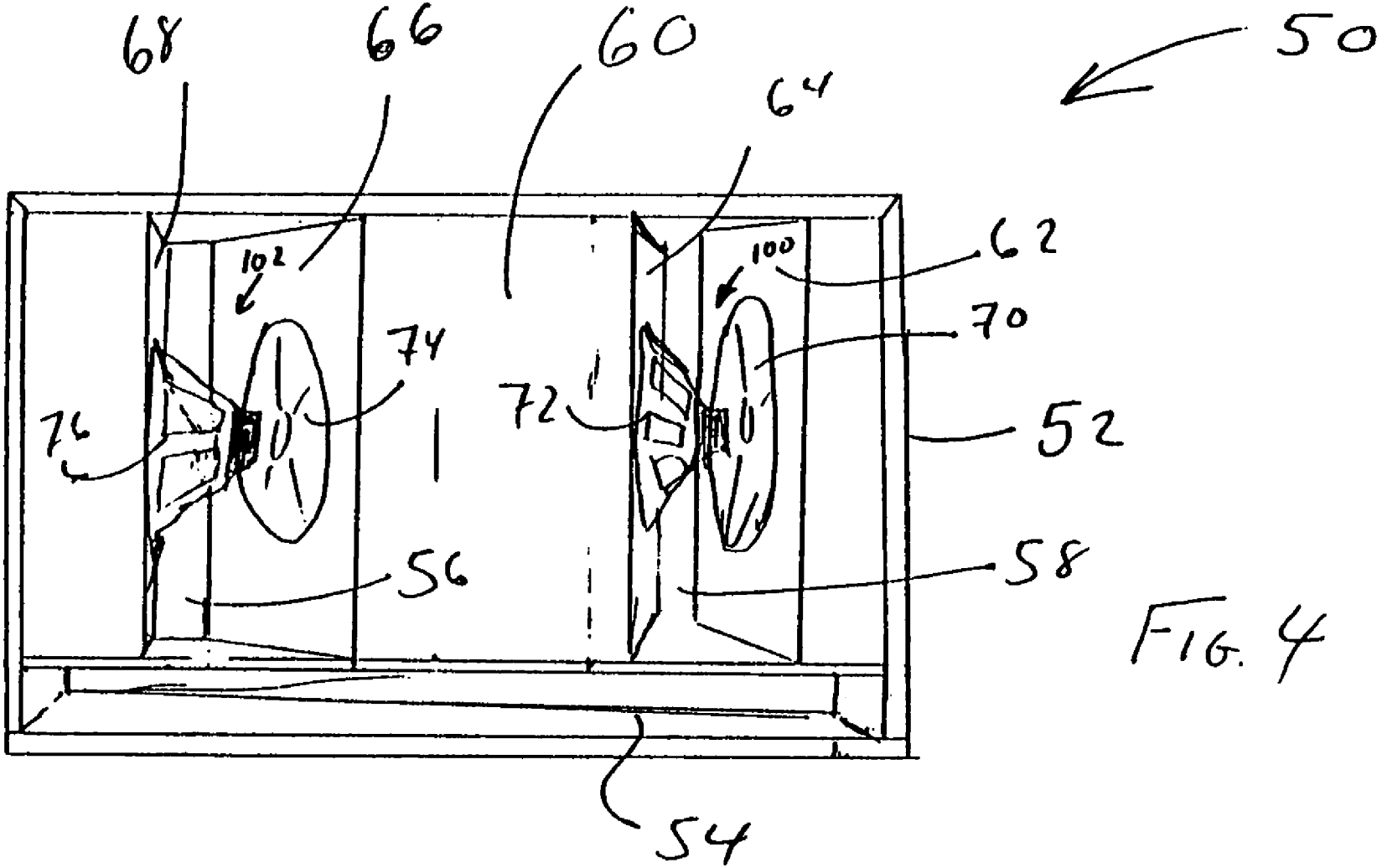
FIG. 4 is a front plan view of a second embodiment of the invention.
Figure 5:
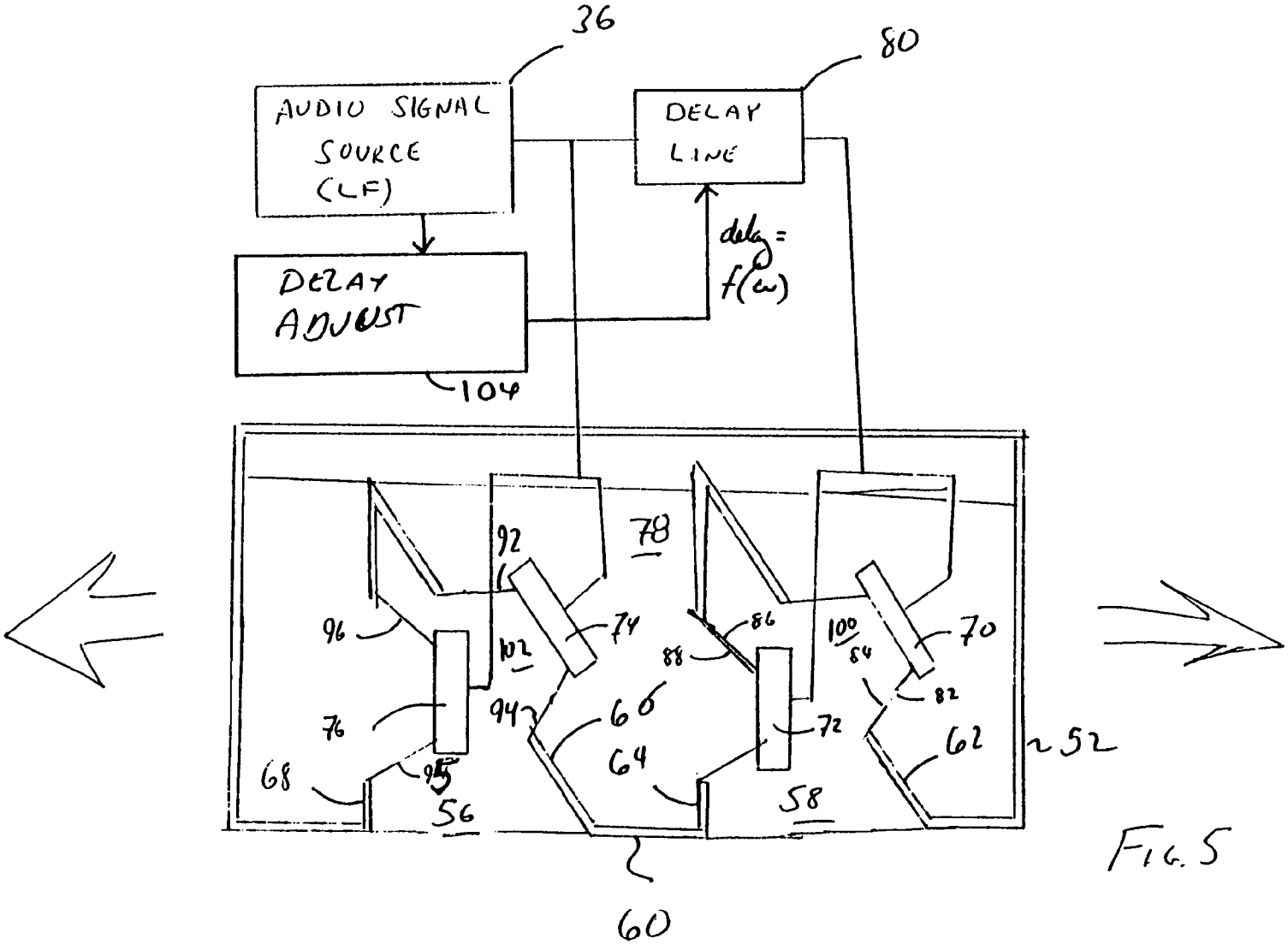
FIG. 5 is a schematic of the second embodiment of the invention.
Figure 6:
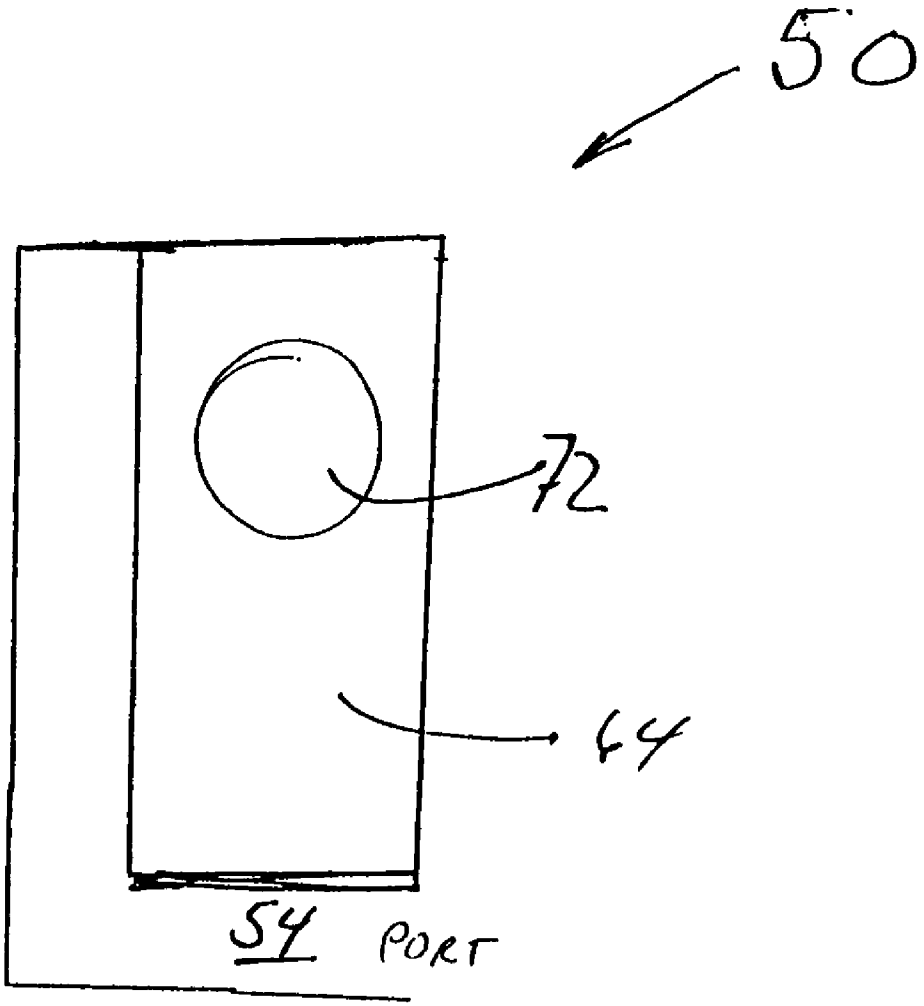
FIG. 6 is a cross sectional view of the second embodiment of the invention.

Referring to FIGS. 4-6, a loudspeaker system 50 constructed in accordance with a second embodiment of the invention is shown. Loudspeaker system 50 provides first and second pairs 100, 102 of transducers (70 and 72 for pair 100 and 74 and 76 for pair 102, respectively) mounted on a bass-reflex enclosure 52. Bass-reflex enclosure 52 incorporates four baffles 62, 64, 66 and 68, in which are mounted, loudspeakers 70, 72, 74 and 76 respectively. The arrangement of each pair 100, 102 is similar to the arrangement of transducer pair 35 described above with respect to the single pair system. The baffles 62, 64, 66 and 68 are disposed to define mouths 58 and 56 in front face 60 of enclosure 52. A port 54 is located below the mouths 56 and 58, though it could be located between the mouths or to either side in the front face 60.

As best viewed in FIG. 5, the pairs 100 and 102 of transducers are disposed aligned on one another behind and parallel to the front face 60 in narrow V-shaped indentations into enclosure 52. As in the first embodiment, loudspeakers 70, 72, 74 and 76 are woofers, mounted in baffles 62, 64, 66 and 68. Loudspeakers 70, 72, 74 and 76 are mounted front to back with the backside 86 of loudspeaker 72 nestled into the frontside 84 of loudspeaker 70 and with the backside 95 of loudspeaker 76 nestled into the frontside 94 of loudspeaker 74. Loudspeakers 72 and 76 are oriented with their respective frontsides 88 and 96 oriented to radiate into the interior volume 78 and loudspeakers 70 and 74 oriented to radiate sound energy from their backsides 82 and 92 into interior volume 78. The proximity of the voice coils in the pairs 100 and 102 of transducers improves acceleration and then the efficiency of the system. Again, the mouths 56, 58 are tuned, as are the volumes of the indentations behind the mouths, to a resonant frequency. Similarly, enclosed volume 78 is tuned to a resonant frequency.

Loudspeaker system 50 provides for control over the directivity of sound radiated by the system. Directivity is provided by incorporating the second pair of transducers, constructed after the pattern of the first pair, but spaced from the first pair along and parallel to the front face 60 of bass-reflex enclosure 52. The drive signal supplied the two pairs 100 and 102 of transducers is time differentiated using a delay line 80 to control the phase difference between the pairs and to focus and direct the sound lobe generated by loudspeaker system 50. A substantial part of the sound energy can be directed into a narrow width lobe aimed from one side of bass-reflex enclosure 52 by placing pairs 100, 102 a distance of 2 wavelengths apart (for a given design frequency) and driving them at 180 degrees out of phase. Variation of frequency around the design frequency can be compensated for by adjusting the delay to vary the degree to which signals applied to the transducer pairs are out of phase with one another. The delay is calculated using a delay adjust processor 104 to control the delay line 80. Audio signal source 36, delay line 80 and delay adjust processor may all be realized in a digital signal processor.

The invention achieves high efficiency through improved voice coil response and, in the second embodiment, by dynamic control of the lobe of radiated energy by adjustment of the relative phase of a drive signal supplied each of two transducer assemblies.

While the invention is shown in only one of its forms, it is not thus limited but is susceptible to various changes and modifications without departing from the spirit and scope of the invention.

What is claimed is:

1. A loudspeaker system comprising:

a first pair of transducer assemblies including a first transducer assembly having a front side and a back side and a second transducer assembly having a front side and a back side;

an enclosure supporting the first and second transducer assemblies and having an internal volume;

the first transducer assembly being supported on the enclosure to radiate sound energy from its front side directly into the internal volume;

the second transducer assembly being supported on the enclosure to radiate sound energy into the internal volume from its back side; and the first and second transducer assemblies being oriented with respect to one another such that the back side of the first transducer is partially nested in the front side of the second transducer, the respective front and back sides being spaced and open to the environment along a part of an edge thereof.

2. The loudspeaker system as set forth in claim 1, further comprising the first transducer assembly being canted with respect to the second transducer assembly.

3. The loudspeaker system as set forth in claim 2, further comprising a port from the internal volume.

4. The loudspeaker system as set forth in claim 3, further comprising the first and second transducer assemblies being set one each in legs of a narrow V indent extending into the enclosure from a side thereof.

5. The loudspeaker system as set forth in claim 4, further comprising:

a audio frequency driver connected to the first pair of transducers for energizing the first and second transducers in phase with one another, and the acoustic centers of the first and second transducers being spaced by no more than one quarter of a wavelength of sound energy at a design limit frequency.

6. The loudspeaker system as set forth in claim 4, further comprising:

a second pair of transducer assemblies including a third transducer assembly supported on the enclosure to radiate sound energy from its front side directly into the internal volume and a fourth transducer assembly supported on the enclosure to radiate sound energy into the internal volume from its back side; and the third and fourth transducer assemblies being oriented with respect to one another such that the back side of the first transducer is partially nested in the front side of the second transducer, the respective front and back sides being spaced and open to the environment along a part of an edge thereof.

7. The loudspeaker system of claim 6, further comprising:

the third and fourth transducer assemblies being set one each in legs of a narrow V indent extending into the enclosure from a side thereof.

8. The loudspeaker system of claim 7, further comprising:

an audio driver coupled to energize the third and fourth transducer assemblies in phase with one another with the acoustic centers of the transducer assemblies of the second pair of transducer assemblies being spaced by no more than one quarter of a wavelength of sound energy radiated at a design limit frequency.

9. The loudspeaker system of claim 8, wherein the first and second pairs of transducers are axially aligned on the centers of one of the transducer assemblies of each pair of transducer assemblies and the first and second pairs of transducer assemblies have the same design limit frequency.

10. The loudspeaker system of claim 9, further comprising:

a common source for an energization signal for the first and second pairs of transducers; and a timing differentiation element for introducing phase differentiation in the sound energy produced by the first pair of transducer assemblies and the second pair of transducer assemblies.

11. The loudspeaker system of claim 10, where the timing differentiation element controls phase differentiation as a function of the frequency of the energization signed.

12. A loudspeaker system comprising:

an enclosure having a front face and enclosing an interior volume;

a first pair of substantially opposed baffle boards having inside and outside edges, the outside edges of the baffle boards being located across a gap in the front face and the inside edges meeting along an axis parallel to the front face;

a first diaphragm loudspeaker mounted on a first of the first pair of substantially opposed baffle boards oriented to have a front face directed into the interior volume;

a second diaphragm loudspeaker mounted on a second of the first pair of substantially opposed baffle boards oriented to have a front face substantially directed into a back face of the first diaphragm loudspeaker and partially oriented toward the gap in the front face; and a port from the interior volume.

13. The loudspeaker system of claim 12, further comprising:

the first and second diaphragm loudspeakers being spaced apart at their respective acoustic center points by no more than a quarter wavelength of radiated sound energy at a design frequency; and an acoustic driver coupled to the energize the first and second diaphragm loudspeakers in phase with one another.

14. The loudspeaker system of claim 13, further comprising:

a second pair of substantially opposed baffle boards having inside and outside edges, the outside edges of the baffle boards being located across a gap in the front face and the inside edges meeting along an axis parallel to the front face;

a third diaphragm loudspeaker mounted on a first of the second pair of substantially opposed baffle boards oriented to have a front face directed into the interior volume; and a fourth diaphragm loudspeaker mounted on a second of the second pair of substantially opposed baffle boards oriented to have a front face substantially directed into a back face of the first diaphragm loudspeaker and partially oriented toward the gap in the front face.

15. The loudspeaker system of claim 14, further comprising:

the third and fourth diaphragm loudspeakers being spaced apart at their respective acoustic center points by no more than a quarter wavelength of radiated sound energy at a design frequency; and an acoustic driver coupled to the energize the third and fourth diaphragm loudspeakers in phase with one another.

16. The loudspeaker system of claim 15, wherein a signal from the acoustic driver for application to the third and fourth diaphragm loudspeakers is delayed respective the signal for the first and second diaphragm loudspeakers.

17. The loudspeaker system of claim 16, wherein the delay is selectable to control the direction of a lobe of sound energy radiated by the loudspeaker system.

18. The loudspeaker system of claim 15, wherein the delay is a function of dominant frequency of the signal from the acoustic driver.

* * * * *